US008276999B2

(12) United States Patent
Hassman et al.

(10) Patent No.: US 8,276,999 B2
(45) Date of Patent: Oct. 2, 2012

(54) COLLAPSIBLE PORTABLE BAR

(75) Inventors: Ellen Hassman, Hollywood, FL (US); Kathleen Casey, Hollywood, FL (US); Mark Steven Chrislip, Green Oaks, IL (US)

(73) Assignee: Consumer Motivation Group, Inc., New York, NY (US)

( * ) Notice: Subject to any disclaimer, the term of this patent is extended or adjusted under 35 U.S.C. 154(b) by 327 days.

(21) Appl. No.: 12/701,771

(22) Filed: Feb. 8, 2010

(65) Prior Publication Data

US 2011/0006654 A1 Jan. 13, 2011

Related U.S. Application Data

(60) Provisional application No. 61/270,705, filed on Jul. 13, 2009.

(51) Int. Cl.
*A47B 47/00* (2006.01)

(52) U.S. Cl. ..... 312/6; 108/158.11

(58) Field of Classification Search .... 312/140.1–140.4, 312/265.1–265.4, 3–6, 351, 290; 108/190, 108/193, 186, 187, 158.11, 157.18, 159.11, 108/157.14; 190/4–7, 9, 12 R, 13 R, 14; 383/38; 220/475, 4.28, 9.1–9.3, 507; 211/189, 211/182, 195, 201; 135/96, 123, 121, 140, 135/157, 143

See application file for complete search history.

(56) References Cited

U.S. PATENT DOCUMENTS

| | | | | | |
|---|---|---|---|---|---|
| 509,197 | A * | 11/1893 | Clark | 190/4 |
| 832,625 | A * | 10/1906 | Ryan | 312/6 |
| 931,826 | A * | 8/1909 | Werstad | 312/290 |
| 1,524,249 | A * | 1/1925 | Jarvis et al. | 312/300 |
| RE16,664 | E * | 6/1927 | Gilmore | 190/12 R |
| 2,440,192 | A * | 4/1948 | Cowan | 312/6 |
| 2,744,711 | A * | 5/1956 | Myers | 248/165 |
| 2,963,761 | A * | 12/1960 | Haydock | 403/188 |
| 3,217,673 | A * | 11/1965 | Knoblock | 108/159.11 |
| 4,155,311 | A * | 5/1979 | Jackovin | 108/190 |
| 4,382,640 | A * | 5/1983 | Kashden | 312/5 |
| 4,706,573 | A * | 11/1987 | Sielaff | 108/190 |
| 4,875,302 | A * | 10/1989 | Noffsinger | 40/610 |
| 4,946,032 | A * | 8/1990 | Stoddard et al. | 62/457.1 |
| 4,960,144 | A * | 10/1990 | Wheatley et al. | 135/123 |
| 5,622,415 | A * | 4/1997 | Felsenthal et al. | 312/265.4 |
| 5,678,904 | A * | 10/1997 | Hung | 312/3 |
| 5,941,183 | A * | 8/1999 | Ming-Shun | 108/153.1 |
| 5,957,310 | A * | 9/1999 | Mitchell | 211/186 |
| 5,975,773 | A * | 11/1999 | Ben-Yaacov | 396/598 |
| 6,142,589 | A * | 11/2000 | Wang | 312/6 |
| 6,601,928 | B1 * | 8/2003 | Kortman et al. | 312/3 |
| 6,705,108 | B2 * | 3/2004 | Defelice et al. | 62/457.2 |
| 6,871,452 | B2 * | 3/2005 | Berg | 52/63 |
| 6,951,327 | B1 * | 10/2005 | Seo | 248/188 |
| 8,038,235 | B2 * | 10/2011 | Lowery et al. | 312/401 |
| 2007/0215193 | A1 * | 9/2007 | Flores | 135/157 |
| 2008/0006317 | A1 * | 1/2008 | Livacich et al. | 135/123 |

* cited by examiner

*Primary Examiner* — Janet M Wilkens
(74) *Attorney, Agent, or Firm* — Robert M. Downey, P.A.

(57) ABSTRACT

A compact collapsible bar includes a rigid top frame and a rigid bottom frame. A collapsible fabric enclosure is permanently connected to the top frame and to the bottom frame. A set of rigid collapsible legs is removably connected to the top frame and to the bottom frame. When collapsed, the entire bar assembly can be stored in a compact carrying bag.

13 Claims, 7 Drawing Sheets

COLLAPSIBLE PORTABLE BAR

CROSS REFERENCE TO RELATED APPLICATIONS

This application claims the benefit and priority of provisional patent application No. 61/270,705 filed Jul. 13, 2009 entitled Collapsible Folding Double & Single Bars with Coolers, and which is incorporated herein by reference in its entirety.

BACKGROUND AND SUMMARY

A need exists for a portable compact bar that can be stored in a small storage case or tote bag, manually carried to an event and quickly and easily assembled and disassembled. It is also desirable to have a compact storable bar which can be selectively used around the workplace or home for temporary events, such as indoor and outdoor parties and other occasions. Once an event is over, it is desirable to break down the bar for convenient travel and/or for compact storage.

A particular need exists for a portable compact bar that can be easily transported to virtually any event or venue such as a marketing, sales, promotional or entertainment event, and to provide a temporary refreshment center while simultaneously serving as a product or service promotional center. Moreover, when using a portable bar at entertainment, promotional, marketing, sales and other business or charitable events, it is often desirable to provide promotional messages to those in attendance, such as messages or information promoting a particular food or beverage being served from a temporary bar.

In accordance with this disclosure, the needs noted above can be readily met with an economical, compact, collapsible, lightweight portable bar. The bar includes one or more storage compartments which can removably receive dozens of beverage containers as well as one or more thermally-insulated coolers, such as soft-sided fabric cooler tote bags. The coolers can be sized to receive, hold and keep cool a predetermined number of beverage cans or bottles for serving or dispensing from the bar.

In further accordance with this disclosure, a portable collapsible bar can be fitted with easily mountable and easily removable panels or banners which may display promotional designs and promotional statements for any desired product and/or service.

Another aspect of this disclosure includes a zippered flap or door provided in a sidewall of a portable collapsible bar to allow access to one or more storage compartments. The compartments are sized to efficiently store loose beverage containers as well as removable thermally-insulated waterproof and watertight fabric coolers sized to hold ice and beverage containers. The fabric coolers are fabricated with a plurality of insulating layers to thermally insulate a predetermined number of beverage containers such as, for example, 12, 24, or 36 twelve ounce, sixteen ounce or twenty ounce bottles or cans.

BRIEF DESCRIPTION OF THE DRAWINGS

In the drawings.

In the various view of the drawings like numerals designate like or similar parts.

DESCRIPTION OF REPRESENTATIVE EMBODIMENTS

Figure 1:
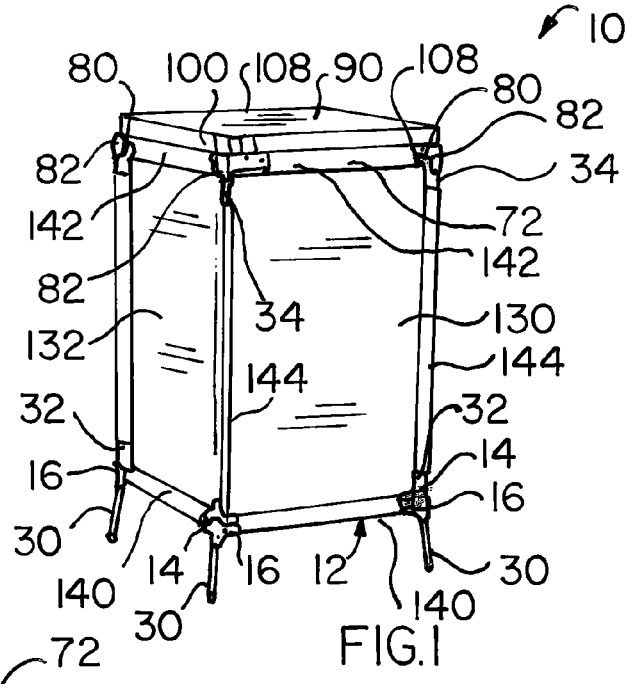
FIG. 1 is a front top perspective view of a collapsible portable cooler bar constructed in accordance with one embodiment of the disclosure.

As seen FIG. 1, a first embodiment of the disclosure includes a collapsible portable cabinet or bar 10. Bar 10 is shown in a fully assembled upright position. Strength and rigidity are provided to the bar 10 with a rigid bottom frame 12, which in this example is constructed of four rigid rods 14 formed of plastic, metal, wood or any other suitable material. Hollow cylindrical steel rods can be coated or painted and advantageously used as rods 14.

Figure 2:
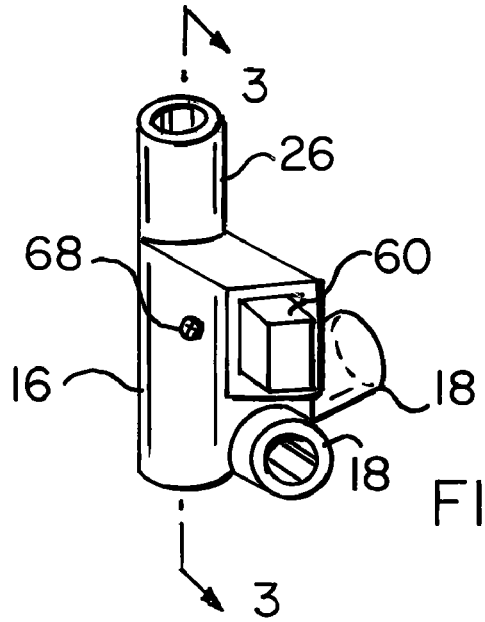
FIG. 2 is a perspective view of a bottom corner bracket used on the cooler bar of FIG. 1.
Figure 3:
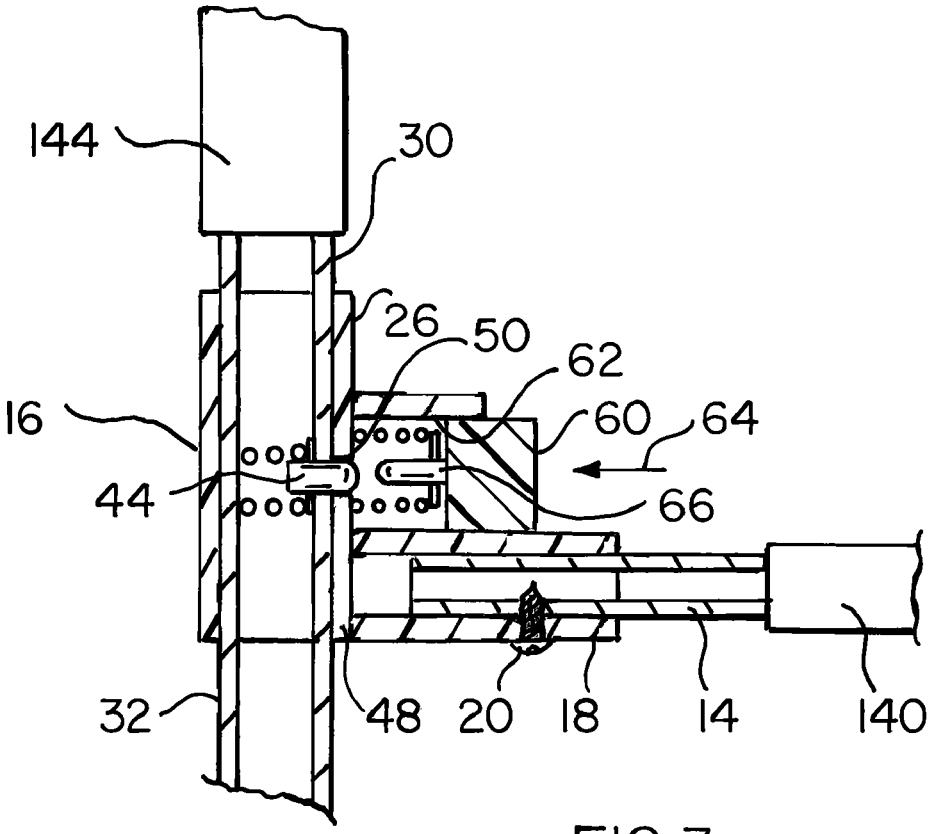
FIG. 3 is a partial view in central axial cross section taken through the corner bracket of FIG. 2 along lines 3-3 thereof and showing the connection of a bottom frame member and a corner leg with the bracket.
Figure 4:
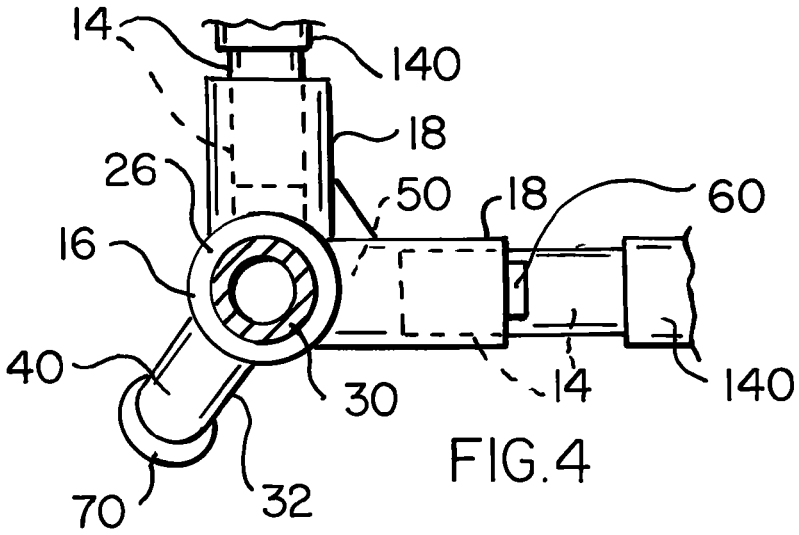
FIG. 4 is a partial top view in partial section of the bottom corner bracket of FIGS. 2 and 3.

The rods 14 serve as bottom frame members which are interconnected in a rectangular or square configuration with four bottom corner brackets 16. Corner brackets 16 can be formed of molded plastic, and as seen in FIGS. 2, 3 and 4, are formed with tubular horizontally-extending perpendicular bottom frame collars 18 for snugly receiving two adjacent end portions of two of the rods 14. The rods 14 can be permanently fixed within the collars 18 with adhesives and/or semi-permanently fixed therein with fasteners such as screws or rivets 20 (FIG. 3).

Figure 5:
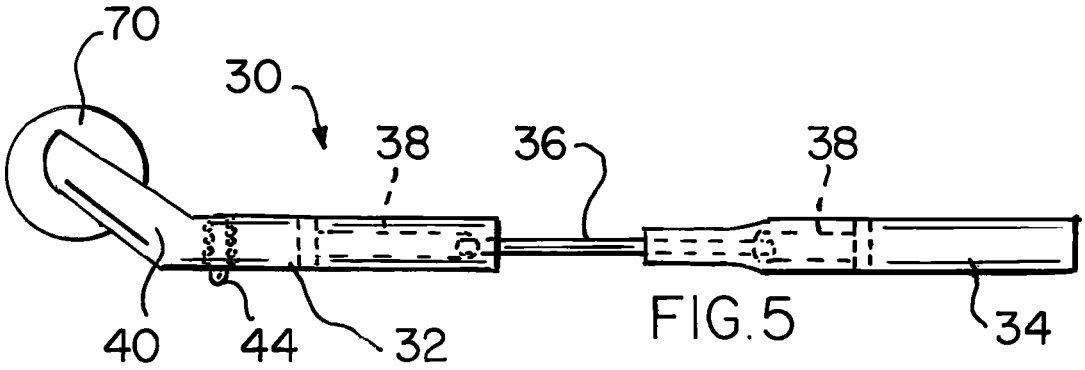
FIG. 5 is a view of a vertical corner leg in an uncoupled or disassembled position.

Each bottom corner bracket 16 also includes a single tubular vertical collar 26 for receiving and supporting a rigid vertical leg 30. Each leg 30 can be formed as an integral collapsible two-piece assembly as shown in FIG. 5. A hollow tubular steel bottom leg portion 32 snugly receives a reduced diameter end portion of a hollow tubular steel top leg portion 34 in a known fashion, such as common with tent poles.

A tensioned cable 36 is connected to an elastic cord or spring 38 fixed within each leg portion 32, 34 to facilitate assembly and storage of the legs 30. The leg portions 32, 34 can be arranged side-by-side for compact storage. The lower end of each bottom leg portion 32 can be bent or formed with a radially-outwardly flared foot portion 40 for providing a larger footprint and increased stability to the assembled bar 10.

A spring-biased snap latch 44 is mounted on each leg 30 above each foot portion 40. The snap latch 44 can be circumferentially offset or rotated by about 135 degrees from the direction of radial flare of the foot portion 40. As seen in FIG. 5, an open slot or guide channel 48 is formed in the bottom of each bottom corner bracket 16 for receiving and guiding the exterior exposed portion of snap latch 44 into latched engagement with a radial bore 50 (FIG. 3) formed through the wall of the vertical collar 26. This arrangement results in the foot portion 40 of each bottom leg portion 32 being positioned outwardly from the bottom frame 12 at an angel of about 135 degrees from the axes of the perpendicular collars 18 on each bottom corner bracket.

A latch release trigger button 60 is provided on each bottom corner bracket 16. Each trigger button 60 is spring-biased outwardly from an internal slideway 62 formed within each bottom corner bracket 16. Depressing trigger button 60 in the direction of arrow 64 causes a latch release finger 66 to unseat and disengage the snap latch 44 from bore 50 and thereby allow removal of each leg 50 from each bottom corner bracket 16. A pin 68 (FIG. 2) extending into a horizontal slot in the trigger button 60 secures the trigger button within the slideway 62 and allows it to slide within the corner bracket 16. A rubber pad 70 may be press fit over the free end of each foot 40 to provide additional stability to the bar 10 and to protect those surfaces on which the bar 10 is supported.

Figure 6:
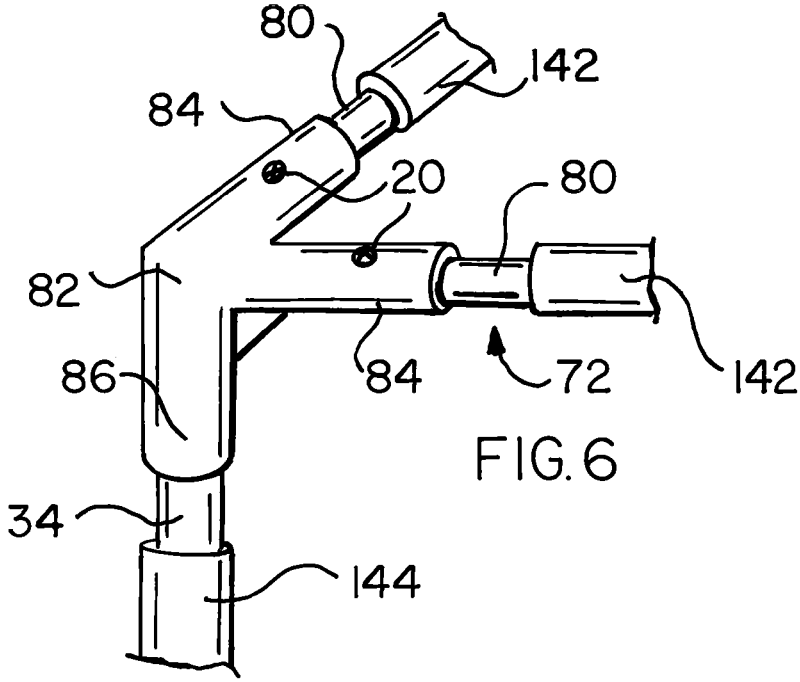
FIG. 6 is a partial top perspective view of a top corner bracket used in the collapsible portable cooler bar of FIG. 1.

As further seen in FIG. 1, the bar 10 further includes a rigid top frame 72 which provides further strength and rigidity to the bar 10. Four rigid top frame members are provided in the form of four rods 80 (FIG. 6). Rods 80 are of the same or similar size and material as the bottom frame rods 14 and are interconnected in a rectangular configuration with four top frame brackets 82. As further seen in FIG. 6, each top frame bracket 82 is formed or molded with two tubular horizontal perpendicular top frame collars 84 and with a single vertical collar 86. The top frame bracket 82 can be formed with a one-piece plastic molded construction.

The two horizontal collars 84 on each top frame bracket 82 respectively receive an end portion of each adjacent rod 80. The rods 80 are permanently or semi-permanently fixed within each respective collar 86 with adhesives and/or fasteners 20. The tubular vertical collar 86 on each top frame bracket 82 receives the end portion of one of the top leg portions 34 of each leg 30 with a snug but removable sliding fit.

Figure 7:
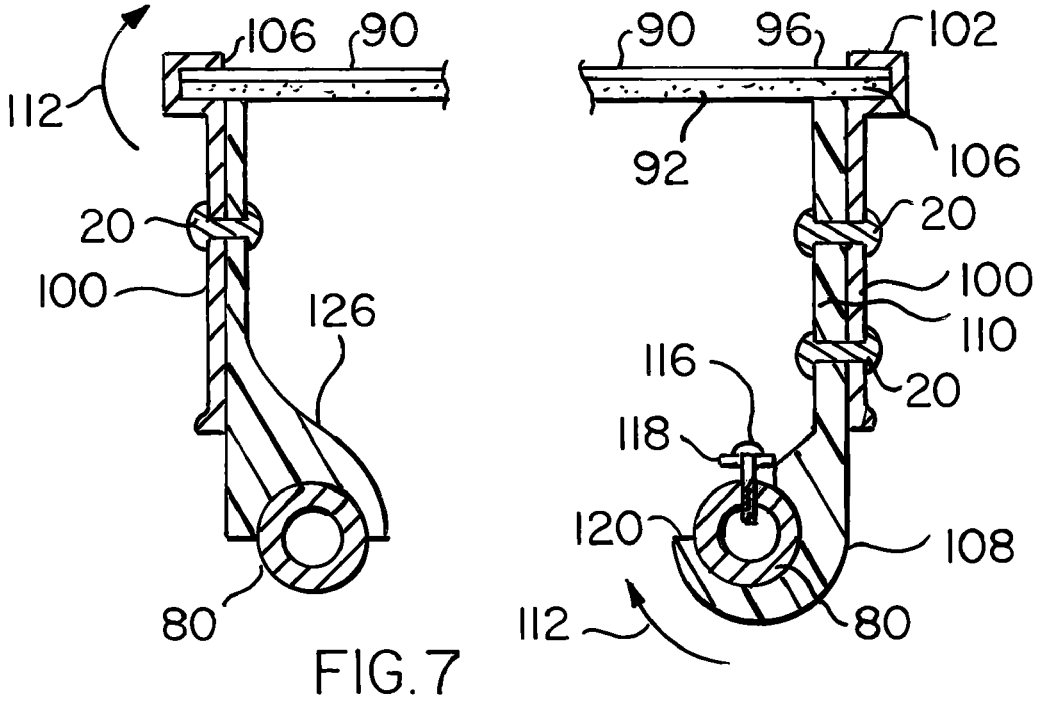
FIG. 7 is a partial elevation view in section taken through a pair of opposed top frame rods and through the countertop journal bearing and countertop latch.

As seen in FIGS. 1 and 7, a rigid lid, cover or countertop 90 is coupled to the top frame 72. Countertop 90 can be fabricated from particle board, plywood, plastic or any other suitable material. In the example shown in FIG. 7, the square planar countertop 90 is formed as a laminate with a particle board base 92 and a glossy top surface 96 which can be formed of any suitable sheet material such as a waterproof plastic material. A coating of paint or the like can also be used for forming top surface 96.

To provide greater convenience and functionality to the bar 10, the countertop 90 can be movably coupled to the top frame 72 as further shown in FIG. 7. A rigid side band 100 formed of a strip of metal or plastic is formed with a top channel 102 which tightly receives the four peripheral edges 106 of the countertop 90. Side band 100 can be tightly wrapped around the countertop 90 and fixed thereto with a rigid bracket or bar 102 (FIG. 8) which overlies opposite abutting free ends 104, 106 of the side band 100. Fasteners 20 can be used to fix the bracket 102 to each free end 104, 106 to maintain the side band in tight surrounding engagement with the countertop 90.

Figure 8:
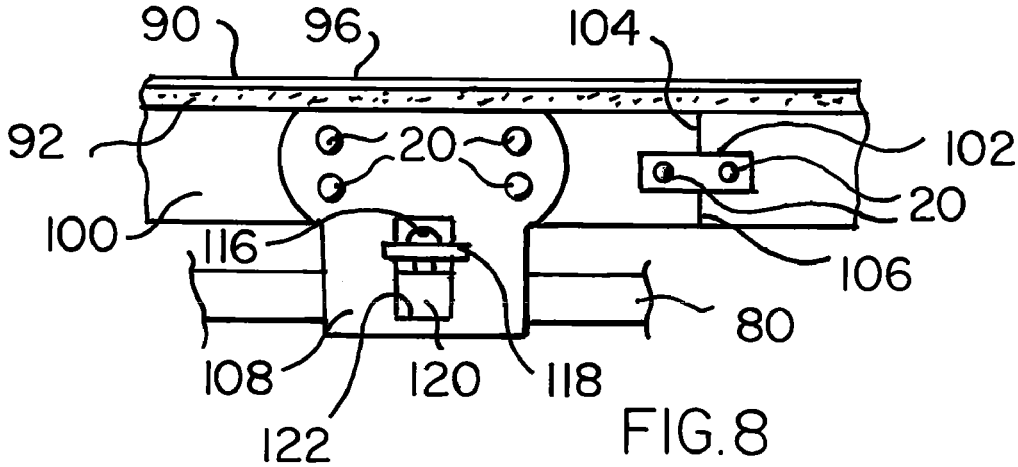
FIG. 8 is a partial view in elevation of the journal bearing of FIG. 7.

As further seen in FIGS. 7 and 8, one or more tubular journal bearings 108 are fixed to one side of the side band 100 with fasteners 20, such as screws or rivets. Fasteners 20 extend through a rigid flange 110 which extends upwardly from the internal journal bearing 108. The journal bearing 108 allows for the free rotation or pivoting of the countertop 90 around one of the rigid rods 80 in the direction of arrows 112. Journal bearings 108 and internal flanges 110 can be molded of rigid plastic and fitted over a rod 80 prior to attachment of the rod to a pair of top frame brackets 82.

Figure 10:
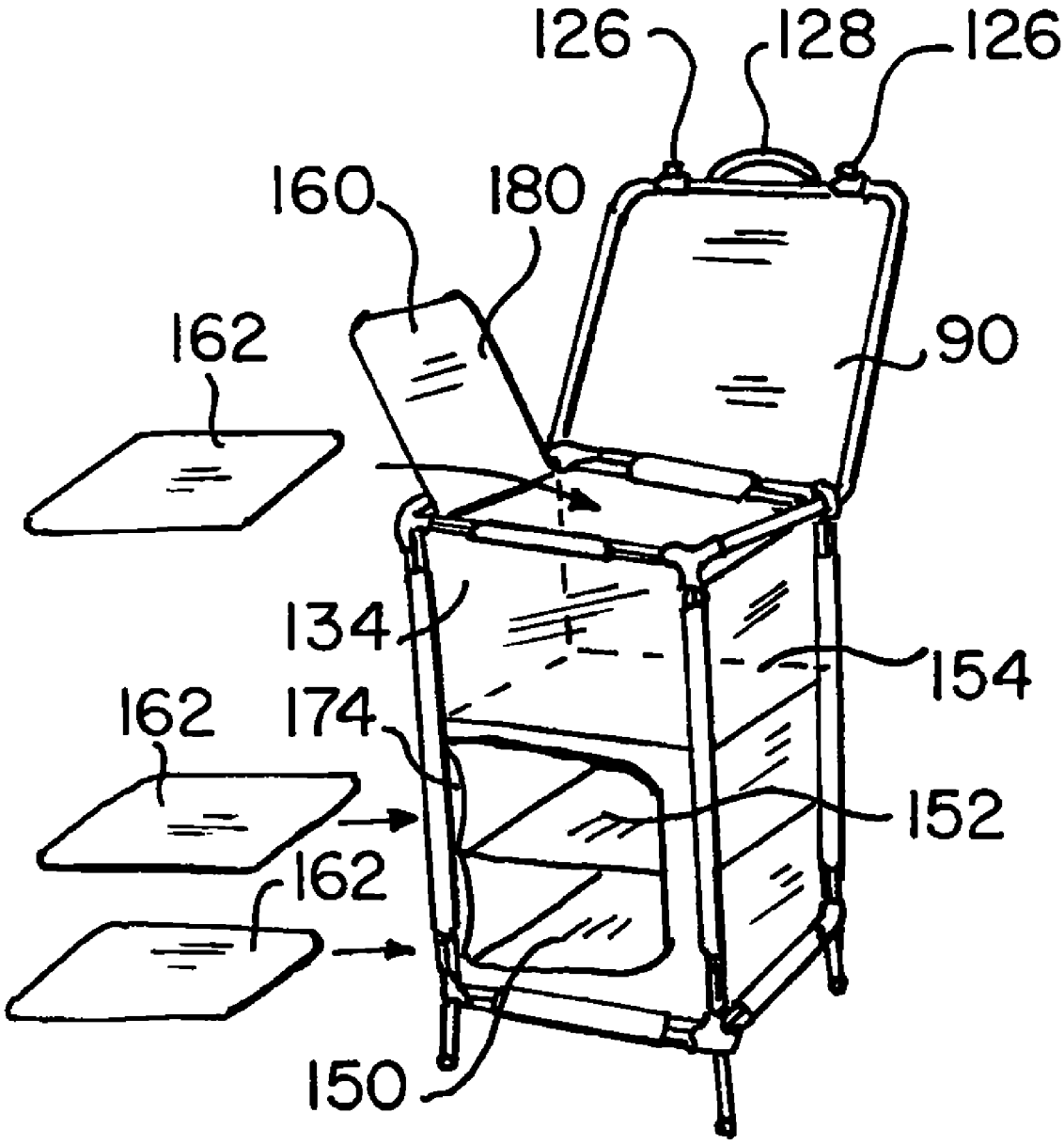
FIG. 10 is a rear perspective view of the compact portable cooler bar of FIG. 1 in an open partially-exploded configuration.

The rotation of the countertop 90 can be limited to a predetermined open position by a stop member such as a screw 116 (FIGS. 7 and 8) fixed to the rod 80 and fitted with a washer 118. A slot 120 formed in the cylindrical wall of the journal bearing 108 allows the countertop 90 to rotate over the extent of slot 120. Upon abutment of the bottom wall 122 of slot 120 with the screw and washer 116, 118, the rotation of the countertop 90 is stopped and the countertop 90 can be held in an open or upright fixed position as shown in FIG. 10. As described further below, this allows selective access to the contents of a top compartment of the bar 10.

Figure 9:
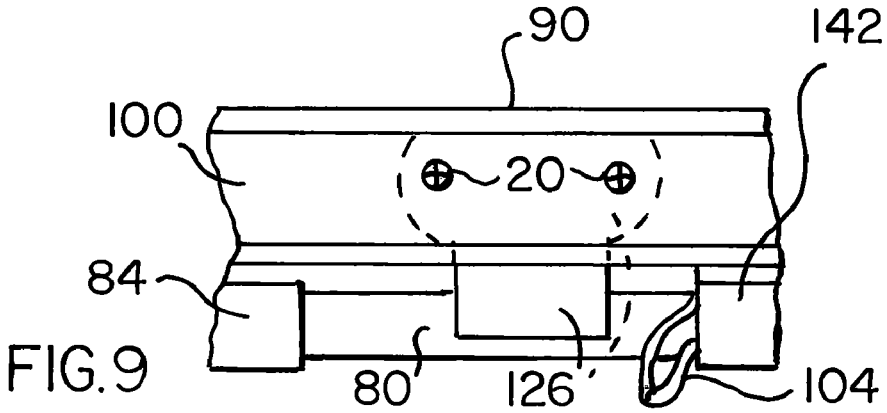
FIG. 9 is a partial view in elevation of the latch of FIG. 7.

As shown in FIGS. 7 and 9, the countertop 90 can be held closed with a resilient latch 126 fixed to the side band 100 on a side of countertop 90 opposite to the journal bearing 108. A small manual lifting force applied to the side band 100 above the latch 126 causes the latch 126 to resiliently release its radial grip on the rod 80 and allow the countertop 90 to be rotated around the opposing rod 80. As seen in FIG. 10, a handle 128 can be connected to the rear edge of the side band 100 to facilitate opening and closing the countertop 90.

As further seen in FIGS. 1 and 10, the bar 10 includes a fabric enclosure formed in this example of four rectangular, flexible, foldable and collapsible sidewalls, a top wall and a bottom wall. The term fabric is meant to include any flexible pliable sheet material including woven and non-woven materials including natural and synthetic materials of the type used for tents, backpacks, luggage, clothing, etc. Polyester fabrics have been found to be suitable for the sidewall, top wall and bottom wall applications.

Figure 11:
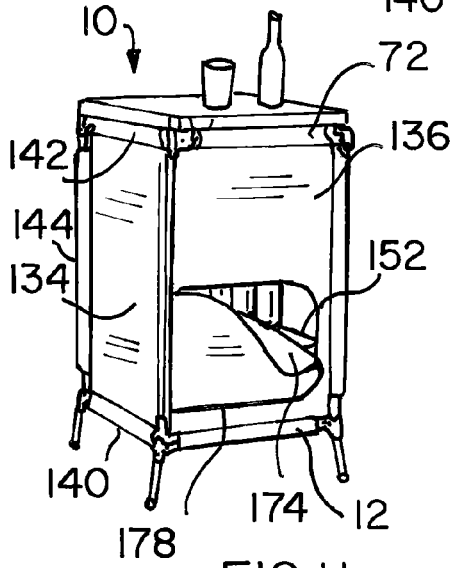
FIG. 11 is a top rear perspective view of the compact portable cooler bar of FIG. 1 showing the bar in use and with a partially open back panel door.

A rectangular front sidewall 130, (FIG. 1) a rectangular left sidewall 132, a rectangular right sidewall 134 (FIG. 11) and a rectangular rear sidewall 136 are tightly tensioned around the bottom frame 12, the top frame 72 and the four corner legs 30. Each sidewall 130-136 is attached to a bottom or lower horizontal tubular mounting sleeve 140, to an upper horizontal tubular top mounting sleeve 142 and to a pair of adjacent vertical mounting sleeves 144. The mounting sleeves 140, 142, and 144 can be formed of the same flexible fabric material as the sidewalls 130, 132, 134 and 136.

During the initial fabrication of the bottom frame 12, the four rigid bottom rods 14 are inserted through each of the four bottom mounting sleeves 140 prior to attachment to the four bottom corner brackets 16. Likewise, during the fabrication of the top frame 72, the four rigid top frame rods 80 are respectively inserted through the four top mounting sleeves 142 prior to attachment to the four top frame brackets 82. The resulting structure (with the legs 30 removed) allows the top frame 72 to freely collapse and rest on top of the bottom frame 12 (or vice versa) with the sidewalls 130, 132, 134 and 136 collapsing or folding in the manner of a bellows or accordion. In this manner, the top frame 72, bottom frame 12 and the four sidewalls can be permanently interconnected for ease of assembly, disassembly and storage. The mounting sleeves and sidewalls can be interconnected with reinforced stitching, adhesive, ultrasonic bonding or any combination thereof.

As further seen in FIG. 10, a flexible first shelf, bottom shelf or floor 150 can be provided within the bottom frame 12. Bottom shelf 150 can be formed of the same or similar material as that used for fabricating the sidewalls. The border of bottom shelf 150 is sewn or otherwise connected to the bottom edge of each sidewall and may also be sewn or attached to the inner edge of each bottom mounting sleeve 140.

A second or intermediate shelf 152, (FIG. 10) also formed of a fabric material like that of the bottom shelf 150 is mounted between the sidewalls 130-136 at a predetermined height, such as 6 or 7 inches, above the bottom shelf. This height can correspond to the approximate height of a beverage can or beverage bottle. While all four edges of the second shelf 152 can be sewn to the sidewalls 130-136, it is also possible to sew or otherwise attach the second shelf 152 to only the left and right sidewalls 132, 134 in the manner of a sling or hammock. A reinforcing rod such as a plastic or wooden dowel can be attached to the front and rear edges of the second shelf 152 to provide added strength and rigidity to the shelf and to the adjacent sidewalls.

A third shelf 154, again formed of a fabric material of the type noted above, is mounted between the sidewalls 130-136 by sewing, bonding, ultrasonic welding or the like to two, three or advantageously all four sidewalls. The vertical spacing of the third shelf 154 above the second shelf 152 can be about 6 or 7 inches to accommodate a plurality of beverage cans or bottles stored on the second shelf 152.

Figure 17:
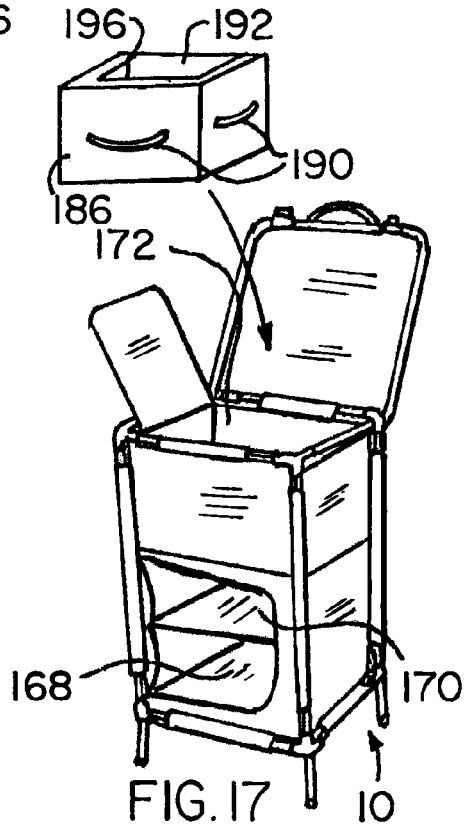

As further seen in FIG. 10, a fabric top cover or top shelf or roof flap 160 is connected along one edge to one of the sidewalls, such as to sidewall 134. This connection can be a permanent sewn connection or a zipper connection. A removable connection such as a zipper connection is provided between at least the other three edges of the roof flap 160 and the sidewalls 130, 132 and 136. The distance of the top or roof flap 160 above the third shelf 154 is dimensioned to receive a flexible waterproof cooler bag as shown in FIG. 17 and as described in more detail below.

In order to provide additional strength and rigidity to the bar 10 and to the first, second and third shelves 150, 152, 154, one or more rigid panels 162 (FIG. 10) can be placed on one or more of the shelves. Panels 162 can be formed of plastic, plywood, particle board and the like. A waterproof laminate or coating can be provided on the top surface of each panel to protect against condensation, liquid spills and the like.

With the construction as described above, a bottom compartment 168 (FIG. 17) is formed between the first and second shelves 150, 152 and the sidewalls, an intermediate or middle compartment 170 is formed between the second and third shelves 152, 154 and the sidewalls, and a third or top compartment 172 is formed between the third shelf 154 and the top shelf or roof flap 160.

Access to the bottom and middle compartments 168, 170 is made available by a rear flap or rear door 174 (FIG. 11) provided in the rear sidewall 136. Rear door 174 can have a rectangular shape, with a zippered connection 178 along three sides as further seen in FIG. 11. Access to the top compartment 170 is made through the top roof hatch or roof flap 160 (FIG. 17). A zippered connection 180 can be provided along three edges of the top flap and the adjacent top edges of three of the sidewalls as shown in FIG. 10 to allow selective access to the top compartment when the countertop 90 is rotated to an open position.

The flexible fabric flaps or doors 160 and 174 may be rolled up in a scroll and held in place by a loop and button fastener or a pair of hook and loop fastening strips. The scrolled roof flap 160 can be fastened open against one of the top frame rods 80 and the scrolled rear flap 174 can be fastened open against one of the legs 30.

Figure 12:
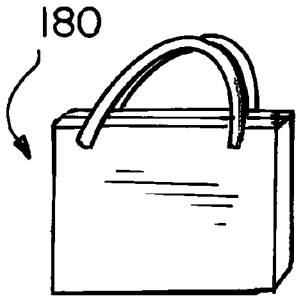
FIG. 12 is a perspective view of a zippered carrying case holding the bar of FIG. 1 in a collapsed storage position.
Figure 13:
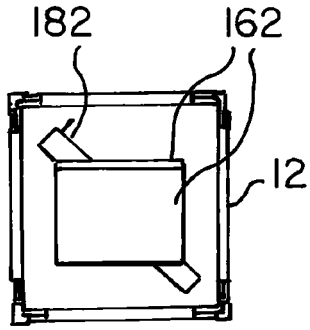
FIG. 13-19 are schematic perspective views of an assembly sequence for assembling the bar of FIG. 1.

As shown in FIG. 12, a compact fabric carrying case and storage bag 180 is designed to hold the entire bar 10 in a compact compressed position as shown in FIG. 13. The bottom frame 12 is positioned directly over the top frame 72 with the fabric material of the sidewalls and shelves folded between the bottom frame 12 and top frame 72. That is, the bottom frame 12, top frame 72 and all of the fabric material of the bar 10 are compressed and stored as a preassembled unit.

The rigid panels 162 are stacked one over the other as shown in FIG. 13 and a storage bag 182 holds each of the legs 30 in a broken down, folded side-by-side position and stored in between the top and the bottom frame and the rigid panels. This entire assembly including a collapsible soft-sided insulated cooler bag (discussed below) can be stacked and stored at a height of only 4 or 5 inches, making the bar 10 easy to store in virtually any closet or other home or office storage space. In one embodiment the bar 10 can be easily stored in a suitcase or fabric storage bag 180 measuring 20 inches by 20 inches by 5 inches corresponding to a bar 10 standing about 34 inches high and having a countertop 90 measuring about 19.5 inches by 19.5 inches.

In order to assemble the bar 10 from its storage position in storage bag 180, the disassembled bar 10 is removed from the bag 180 as shown in FIG. 13 and placed upside down with the countertop 90 on a clean flat surface. The panels 162 are set aside, as are the compressed cooler bag 186 (FIG. 17) and the legs 30 in storage bag 182. The four legs 30 are removed from the storage bag 182 and assembled.

Figure 14:
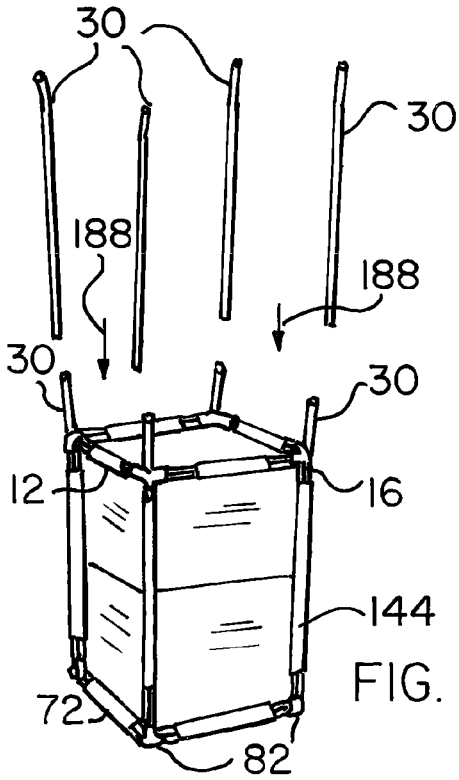

The bottom frame 12 is then pulled upwardly from the top frame 72 in the manner of an accordion to the position shown in FIG. 14. The four legs 30 are then inserted in the direction of arrows 188 through each bottom corner bracket 16, through each vertical mounting sleeve 144 and into each respective top frame bracket 82 as further depicted in FIG. 14. The bottom frame 12 can be pulled upwardly while an assembler pushes down on a leg 30 to cause the snap latch 44 to snap into latched engagement with a radial bore 50 in each bottom bracket 16, as described above.

Figure 15:
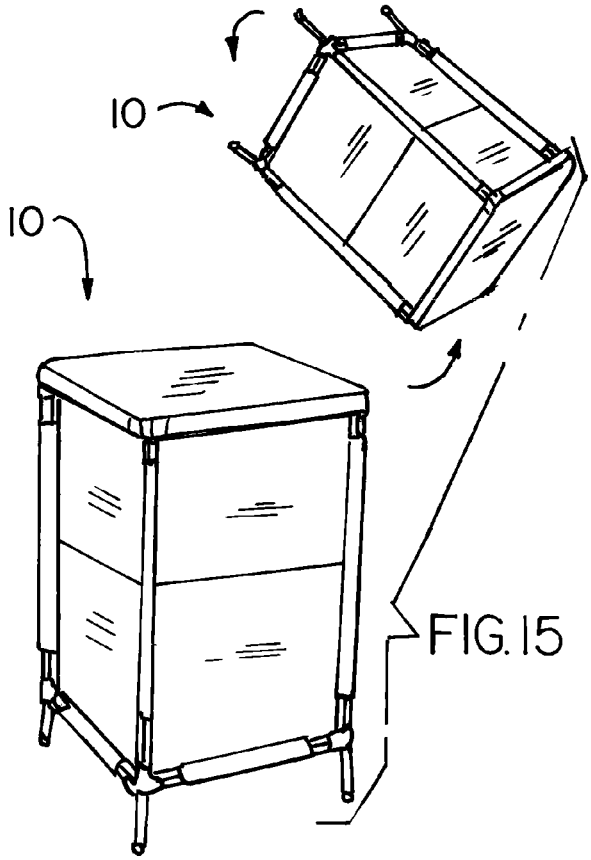
Figure 16:
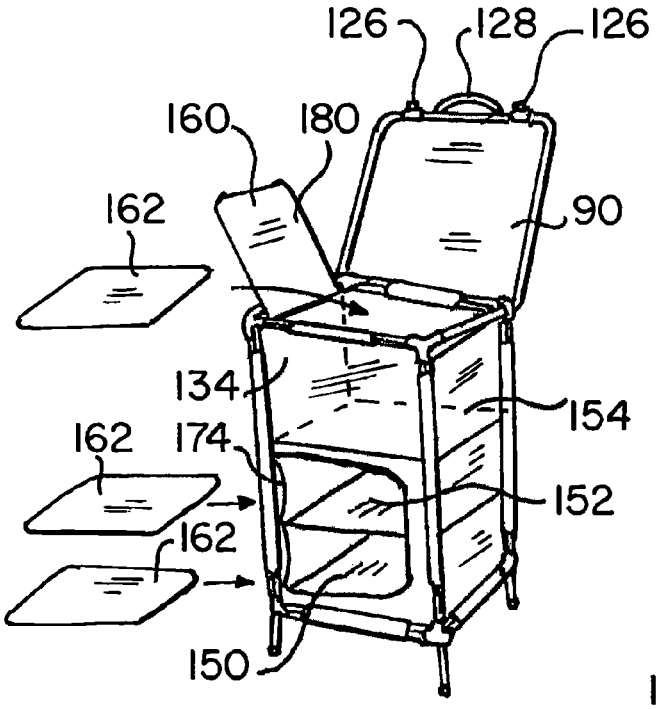

As schematically seen in FIG. 15, the now rigid bar 10 is inverted and turned upright. As seen in FIG. 16, the countertop 90 is pivoted open and the top door or flap 160 and rear door or flap 174 are zipped open. The panels 162 are then placed on the respective shelves 150, 152, and 154.

As seen in FIG. 17, a rectangular box-shaped fabric cooler bag 186 is unfolded from its compressed storage position and inserted in one of the compartments 168, 170, 172. The cooler bag 186 can be fabricated from 420 Denier plastic polyester fabric and heat sealed along all joints and seems to form a waterproof container. The cooler bag 186 is dimensioned to hold ice as well as an assortment of beverage containers such as soft drink cans and bottles as well as canned and bottled adult beverages. The height of the cooler bag can be, for example, 9 or 10 inches and sized to fit closely within one or more of the compartments 168-172.

As further seen in FIG. 17, cooler bag 186 can be placed within the top compartment 172 for facilitating access to iced beverage containers placed therein. Webbed nylon handles 190 facilitate the placement and removal of the cooler bag 186 into and out of the compartments 168-172. A waterproof plastic liner of eva can be bonded to the inner walls of the cooler bag to provide protection against water leakage from melting ice and to provide an additional insulation layer. Additional insulation can be provided between the outer fabric and the inner liner if desired.

The cooler bag 186 can be provided with a top flap or door 192 formed with a three-sided zippered connection 196. This zippered connection allows for quick and easy access to the contents of the cooler bag 186 and for quick and easy closure to prevent rapid warming of any ice and/or cool beverages stored therein.

Figure 18:
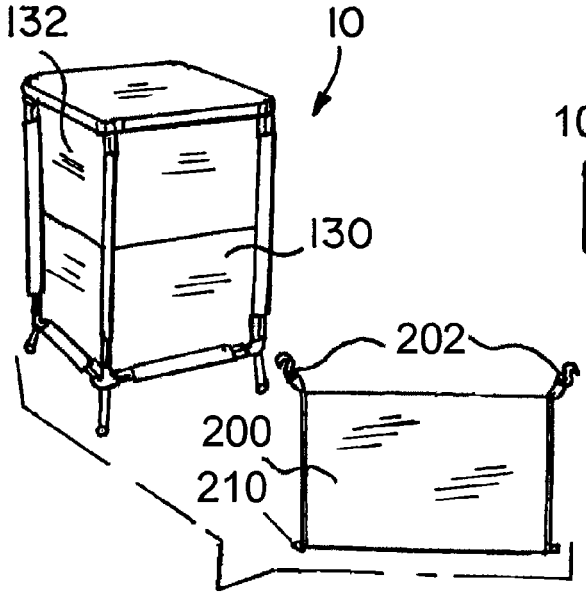
Figure 19:
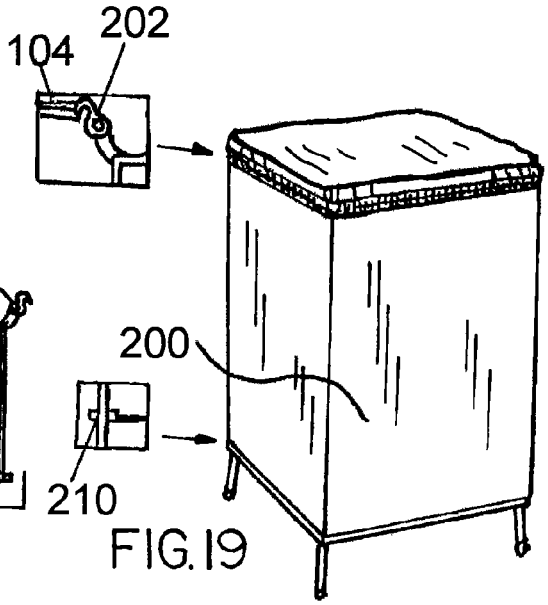

While it is possible to apply promotional and/or informational indicia, designs, logos and/or text directly on the sidewalls 130-136, it is also desirable to provide temporary removable and/or replaceable promotional and/or informational indicia and/or designs, logos and/or text on the bar 10. This can be achieved by the use of removable panels or banners which are removably mountable to the bar 10. As seen in FIGS. 18 and 19, once the bar 10 is assembled as described above, a flexible fabric panel 200 displaying any desired information can be quickly and easily mounted to one or more sides of the bar 10.

In the example of FIGS. 18 and 19, a rectangular fabric banner 200 is provided with a pair of plastic or metal hooks or clips 202 on its upper corners. The length of the banner 200 in this example is dimensioned to tightly wrap around the left, front and right sidewalls 132, 130, and 134 as shown in FIG. 19. A fabric loop 104 (FIGS. 9 and 19) can be attached to the opposite ends of the top mounting sleeve 142 on the rear top frame rod 80 to receive the hooks on clips 202 with a tensioned connection. This connection can hold the banner 200 tightly and neatly in position on the bar 10 as shown in FIG. 19.

If greater security for the banner 200 is desired, an additional pair of hooks or clips 202 can be attached to the lower corners of banner 200 and an additional pair of loops 104 can be attached to the opposite ends of the bottom mounting sleeve 140 so as to provide a taught connection between all four corners of the banner 200 and the bar 10. Of course, many other forms of removable attachments can be provided between the banner 200 and the bar 10, such as hook and loop fasteners 210 (FIGS. 18 and 19) of the type available under the Velcro brand.

If greater security for the banner 200 is desired, an additional pair of hooks or clips 202 can be attached to the lower corners of banner 200 and an additional pair of loops 104 can be attached to the opposite ends of the bottom mounting sleeve 140 so as to provide a taught connection between all four corners of the banner 200 and the bar 10. Of course, many other forms of removable attachments can be provided between the banner 200 and the bar 10, such as hook and loop fasteners 210 (FIGS. 18 and 19).

Once an event is over, the bar 10 can be quickly and easily disassembled in the reverse order as described above. That is, once the banners and/or panels 200 are removed, the bar 10 is inverted, the trigger buttons 60 are depressed and the legs 30 are released and removed (pulled out) from the top and bottom brackets 82, 16. The bottom frame 12 is then compressed onto the top frame 72, with or without removal of the panels 162. The cooler bag 186 should be emptied and dried before being compressed and stored along with the bar 10 in the carrying case 180.

Figure 20:
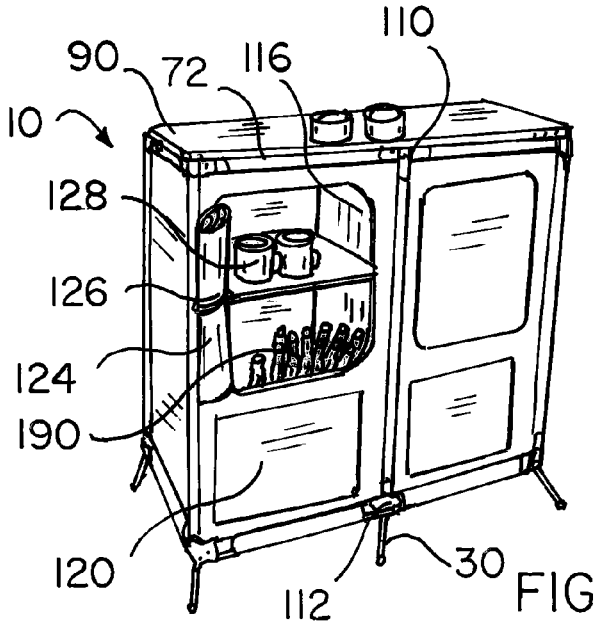
FIG. 20 is a rear top perspective view of an alternate embodiment of a larger collapsible portable cooler bar constructed in accordance with the disclosure.

An alternative embodiment of the disclosure is shown in FIG. 20 wherein a larger bar 10 has a construction substantially the same as that disclosed above, but having more compartments for accommodating a larger number of beverage containers and a larger countertop for serving more people. In this embodiment, an additional pair of front and rear central legs 30 is located midway between the pairs of front and rear corner legs. These central legs 30 removably engage central top frame brackets 110 which are hollow T-shaped brackets fixed to the front and rear top frame rods 80. The central legs 30 also removably latch into central bottom frame brackets 112 with a snap latch interconnection as described above.

In this embodiment, the countertop 90 can be permanently fixed to the top frame 72 with threaded fasteners, rivets and the like. The bar 10 is divided by a central vertical fabric wall 116 which is attached to the front fabric wall, rear fabric wall, top fabric wall and to the bottom fabric floor. Three fabric shelves are attached to the respective sidewalls and central wall 116 as described above.

In this embodiment, a cooler bag 186 can be stored in each bottom compartment through a rear zippered bottom flap 120. Beverage containers 190 are easily accessible through a zippered rear door 124 shown in an open scrolled configuration and held against a corner leg 30 with a pair of hook and loop fabric fastening strips 126.

Rear zippered door 124 extends over an open intermediate compartment as seen in FIG. 20, and over a top compartment within which beverage glasses and/or beer mugs 128 are stored. The open intermediate compartment has a zippered shelf or floor that allows selective access to the beverage containers 190 and cooler bags 186 stored in the bottom compartment.

It is possible to substitute one or more short central legs 30 which terminate at their snap latch connection with the central bottom brackets. Banners and panels may be mounted to this embodiment as described above.

There has been disclosed heretofore the best embodiments of the disclosure as presently contemplated. Obviously, numerous modifications and variations of the embodiments are possible in light of the above teachings. It is therefore to be understood that within the scope of the appended claims, the disclosure and embodiments may be practiced otherwise than as specifically described herein.

What is claimed is:

1. A portable collapsible bar, comprising:

a rigid bottom frame comprising a plurality of rigid body frame members;

a plurality of bottom brackets interconnecting said bottom frame members so as to form said rigid bottom frame;

a rigid top frame comprising a plurality of top frame members;

a plurality of top brackets interconnecting said top frame members so as to form said rigid top frame;

a rigid lid coupled to at least one of said top frame members so as to form a countertop;

at least one tubular journal bearing fixed to an edge of said rigid lid and rotatably coupled to one of said top frame members for allowing pivotal rotation of said rigid lid around said one of said top frame members;

at least one stop member fixed to said one of said top frame members for abutting engagement of said tubular journal bearing therewith for limiting pivotal rotation of said rigid lid between a lowered horizontal position to provide said countertop and a raised position for allowing access into an interior of said portable collapsible bar;

a releasable resilient latch for releasably securing said rigid lid in said lowered horizontal position providing said countertop, and said releasable resilient latch being structured and disposed for releasably grasping one of said plurality of top frame members;

a plurality of fabric sidewalls connected to said plurality of rigid bottom frame members and connected to said plurality of rigid top frame members and surrounding the interior of said portable collapsible bar;

at least one thermally insulated cooler below said rigid lid and extending between said plurality of fabric sidewalls within the interior;

a plurality of zippered flexible doors provided on at least some of said plurality of fabric sidewalls for allowing access to the interior; and a plurality of rigid legs removably coupled to said bottom frame, to said top frame and to said fabric sidewalls.

2. The bar of claim 1, further comprising a fabric shelf extending between and connected to at least two of said fabric sidewalls.

3. The bar of claim 2, further comprising a rigid removable panel supported on said fabric shelf.

4. The bar of claim 1, further comprising a fabric floor coupled to said bottom frame and to said plurality of fabric sidewalls.

5. The bar of claim 4, further comprising a rigid removable panel supported on said fabric floor.

6. The bar of claim 4, further comprising a plurality of collapsible flexible walled compartments provided within said interior.

7. The bar of claim 1, further comprising a fabric top cover coupled to said top frame.

8. The bar of claim 7, further comprising a fabric hatch located in said fabric top cover.

9. The bar of claim 1, further comprising a plurality of fabric sidewall sleeves coupled to said plurality of fabric sidewalls and wherein said plurality of legs extends through said plurality of sidewall sleeves.

10. The bar of claim 1, further comprising a plurality of fabric bottom frame sleeves coupled to said plurality of fabric sidewalls and wherein said plurality of bottom frame members extends through said plurality of bottom frame sleeves.

11. The bar of claim 1, further comprising a plurality of fabric top frame sleeves coupled to said plurality of fabric sidewalls, and wherein said plurality of top frame members extends through said plurality of top frame sleeves.

12. The bar of claim 1, wherein each of said plurality of legs comprises first and second collapsible leg portions.

13. The bar of claim 1, further comprising a banner coupled to said bar and overlying at least one of said fabric sidewalls.

* * * * *